US005860825A

United States Patent [19]

Yodogawa

[11] Patent Number: 5,860,825

[45] Date of Patent: Jan. 19, 1999

[54] SOCKET FOR PRINTED CIRCUIT BOARD

[75] Inventor: Akihiro Yodogawa, Fujisawa, Japan

[73] Assignee: Berg Technology, Inc., Reno, Nev.

[21] Appl. No.: 849,307

[22] PCT Filed: Dec. 20, 1995

[86] PCT No.: PCT/US95/16430

§ 371 Date: May 5, 1997

§ 102(e) Date: May 5, 1997

[87] PCT Pub. No.: WO96/19848

PCT Pub. Date: Jun. 27, 1996

[51] Int. Cl.[6] ..... H01R 13/62

[52] U.S. Cl. ..... 439/326

[58] Field of Search ..... 439/326

[56] References Cited

U.S. PATENT DOCUMENTS

| | | | |
|---|---|---|---|
| 4,986,765 | 1/1991 | Korsunsky et al. | 439/326 |
| 5,145,396 | 9/1992 | Yeung | 439/326 |
| 5,161,995 | 11/1992 | Bakke et al. | 439/326 |
| 5,203,725 | 4/1993 | Brunker et al. | 439/636 |
| 5,584,711 | 12/1996 | Arai et al. | 439/326 |

*Primary Examiner*—Neil Abrams
*Assistant Examiner*—Javaid Nasri
*Attorney, Agent, or Firm*—Daniel J. Long; M. Richard Page

[57] ABSTRACT

A socket for a printed circuit board which includes a housing having an insertion opening for receiving the printed circuit board. This opening is provided between first and second opposed walls wherein the first wall is shorter than the second wall. A plurality of spring contacts having contacts project from both of the walls into the insertion opening and form rows extending along the axis of the insertion opening. A pair of latch arms extend from those portions of said housing which are close to the ends of the insertion opening so they may be pushed outwardly by the sides of the printed circuit board when the printed circuit board is rotated in such a direction as to press the contacts. They are returned to initial positions by virtue of their elastic force when the printed circuit board passes so as to then hold the board in position. Holder members partially project from the first wall and a latch guide arranged between the holder members and the latch arms to prevent the printed circuit board urged by the spring contacts from rotating at an angle more than a predetermined value when the latch arms release the printed circuit boards. The housing and said latch arms are formed of an integral member made of insulating material.

5 Claims, 4 Drawing Sheets

SOCKET FOR PRINTED CIRCUIT BOARD

BACKGROUND OF THE INVENTION

This invention relates to a socket for a printed circuit board, into which an edge portion of the printed circuit board can be directly inserted, as a plug, to form a direct connector.

Recently, various direct connectors of low inserting force type have been developed to meet the demand for high-density fitting.

Generally, such a connector of low inserting force type has a plurality of spring contacts aligned in a hosing which is made of an insulating material and which constitutes a socket. The contact portions of the spring contacts are projected into an opening in order to insert a printed circuit board called a daughter board. The contact portions are arranged in two rows extending along the insertion opening. Between the rows of the contact portions there is provided a clearance for accommodating an edge portion of the printed circuit board. The contact portions of one row are arranged in offset fashion with respect to those of the other row, in the depth direction of the insertion opening, i.e. the direction in which the printed circuit board is to be inserted. When the printed circuit board is inserted, one surface of the edge portion contacts the contact portions of both rows, at a position close to the top of the edge portion, and the other surface contacts them at a position far therefrom.

When the edge portion of the printed circuit board is inserted into the gap between the contact rows and the printed circuit board is rotated, moving the contact rows away from each other, the contact portions of the spring contacts are displaced. Due to the spring force biasing the contact portions toward their initial positions, the contact portions reliably contact the wires, respectively, when arranged at the edge portion of the printed circuit board.

To reliably fix the printed circuit board to the housing, with the spring contacts maintained in the preferable contact with the printed circuit board, a latch mechanism is provided which holds the printed circuit board in its rotated position and secures the same to the housing.

Various types of latch mechanism have been developed.

A latch mechanism described in, for example, U.S. Pat. No. 4,986,765, comprises latch members shaped like leaf springs and formed of metal plates. These latch members hold a printed circuit board. They have spring portions set in the recesses made in the proximal portion of the housing, fitting portions projecting downward from the spring portions and inserted into an insertion opening of the proximal portion of the housing, and latch portions arranged above the spring portions. The latch portions have guide portions and cutouts. The guide portions abut on the edges of the printed circuit board to bias the spring portions outwards when the printed circuit board is rotated. The cutouts receives the side edges of the printed circuit board, thereby to hold the printed circuit board at a predetermined rotated position.

U.S. Pat. No. 5,161,995 discloses a latch mechanism comprising latch members which are shaped like leaf springs and formed of metal plates, like those described above. Each latch member has a fitting portion and a latch portion. The fitting portion is arranged at the lower side of spring portions, and the latch portion at the upper side thereof. The fitting portion has a pair of U-shaped fitting arms wound around a support pole positioned near the insertion opening of the printed circuit board. The fitting arms make an effect supporting a reaction force of the springs. Furthermore, the latch portions form guide surfaces for engaging with the edge of the printed circuit board and for biasing the spring portions outward when the printed circuit board is rotated, and engaging walls for engaging with one surface of the printed circuit board to prevent the printed circuit board from returning.

In either latch mechanism described above, the printed circuit board can easily be held or released, taking advantage of the characteristics of the metallic leaf springs.

Either type of the latch mechanism can be further improved in view of the fact that each latch members is formed of a metal plate.

While the printed circuit board is being fitted and rotated, the latch members are bent against the spring force, sliding along the guide portions or guide surfaces of the latch portions. A coated layer or an insulated substrate of the printed circuit board may therefore be damaged by the contact with the latch members or its sliding operation. Particularly, if the printed circuit board is relatively large or if more spring contacts are used because the printed circuit board has high density, the force these spring contacts generate will increase. Therefore, if the latch members are formed large enough to withstand the force, a greater force is required to bend the latch members. This increases the possibility that the printed circuit board is damaged.

At the time the latch members release the printed circuit board, it is desirable that the printed circuit board is made to jump and be reliably prevented from falling out of the socket due to the bias.

SUMMARY OF THE INVENTION

This invention has been made in consideration of the above. Its object is to provide a socket for a printed circuit board, which has no metal members exposed and which can easily and reliably hold and release a printed circuit board without damaging the circuit even if it has many spring contacts.

A socket for a printed circuit board according to this invention comprises: a housing having an insertion opening for receiving the printed circuit board, said opening provided between a pair of opposing walls; a plurality of spring contacts having contacts projecting from at least one of the walls into the insertion opening and forming rows extending along the axis the insertion opening; a pair of latch arms extending from those portions of said housing which are close to the ends of the insertion opening, to be pushed outwards by the sides of the printed circuit board when the printed circuit board is rotated in such a direction as to press the contacts, and to be returned to initial positions by virtue of their elastic force when the printed circuit board passes, so as to hold the printed circuit board against an urging force of said spring contacts; holder members projecting from the other of said walls, for preventing the printed circuit board urged by the spring contacts from rotating at an angle more than a predetermined value when the latch arms release the printed circuit board. The housing and the latch arms are formed of an integral member made of insulating material.

It is desirable that the holder members be arranged in the vicinity of the latch arms, and that one of said walls project beyond said holder members.

When the printed circuit board is inserted into the insertion opening of the housing, the contacts come into contact with conductive portions arranged an edge portion at a proximal side of the printed circuit board. When the printed circuit board is rotated, pressing these contacts, against an urging force of the spring contacts, the latch arms are moved outwards, guided by the printed circuit board. As the printed circuit board is further rotated, beyond the latch arms, the latch arms return due to their elastic force, holding the printed circuit board. To release the printed circuit board, the latch arms are moved outward. Now released from the latch arms, the printed circuit board is rotated around its proximal end by the bias of the spring contacts. As long as it is held by the holder members, the printed circuit board projects from a wall of the housing while being rotated at a predetermined angle.

When the holder members are arranged near the latch arms, the side of the printed circuit board are held. When one of the walls projects beyond the holder members, the wall extending along the longitudinal direction of the insertion opening is entirely exposed.

DETAILED DESCRIPTION

Figure 1:
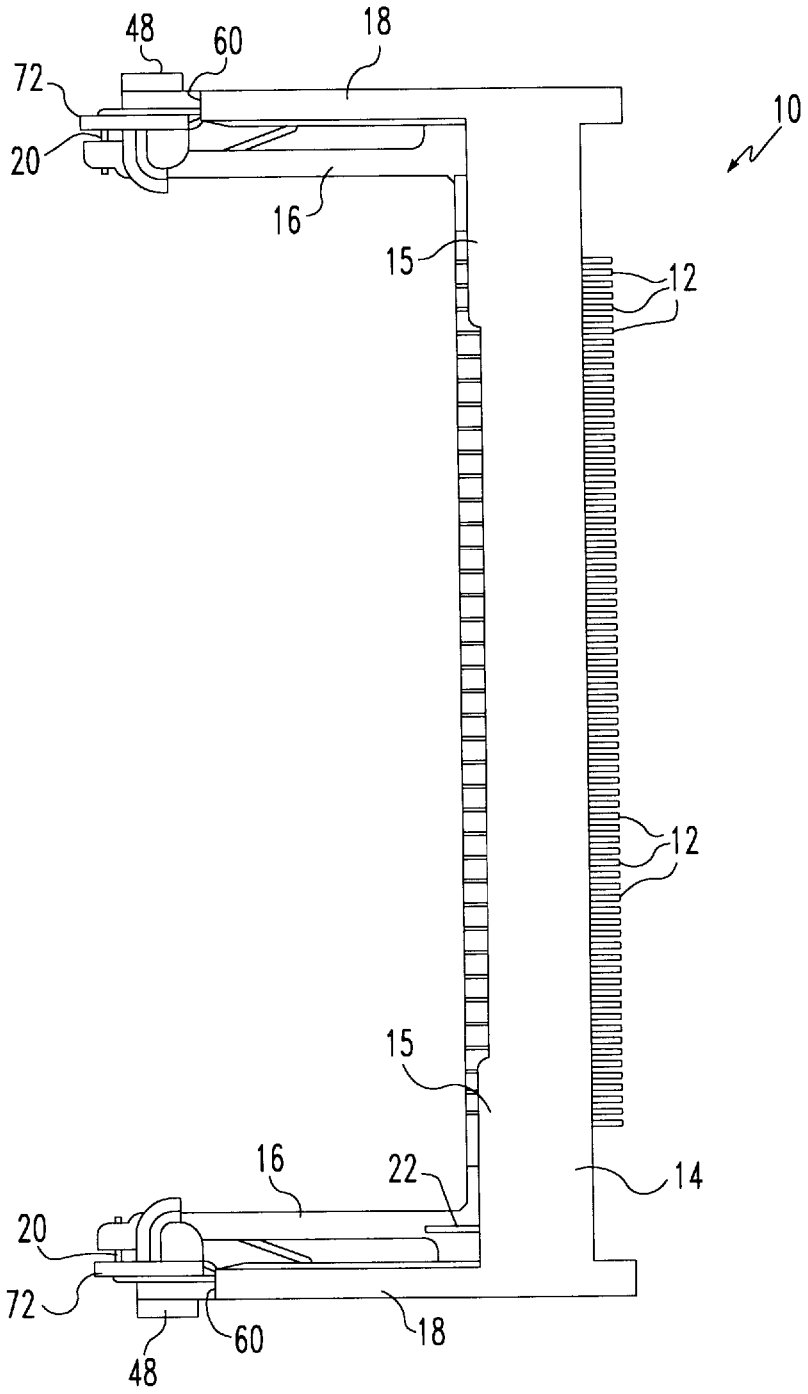
FIG. 1 is a schematic plain view of a socket for a printed circuit board according to an embodiment of this invention.

FIGS. 1 to 6 show a socket 10 for a printed circuit board according to an embodiment of this invention. As shown in FIG. 1, the socket 10 for a printed circuit board comprises a housing 14 having many spring contacts 12 arranged at predetermined intervals. A pair of latch arms 16 extend from both end portions of the housing 14, respectively, and a pair of support arms 18 extend therefrom. The support arms 18 support latch guides 20 respectively, as will be described below. The latch guides 20 guide the latch arms 16. The housing 14, latch arms 16 and support arms 18 are formed as an integral member, made of, for example, an insulating material such as LCP (liquid crystal polymer). Reference numeral 22 denotes a polarity key, which prevents the erroneous insertion of the printed circuit board 8 (see FIGS. 3 and 5).

Figure 2:
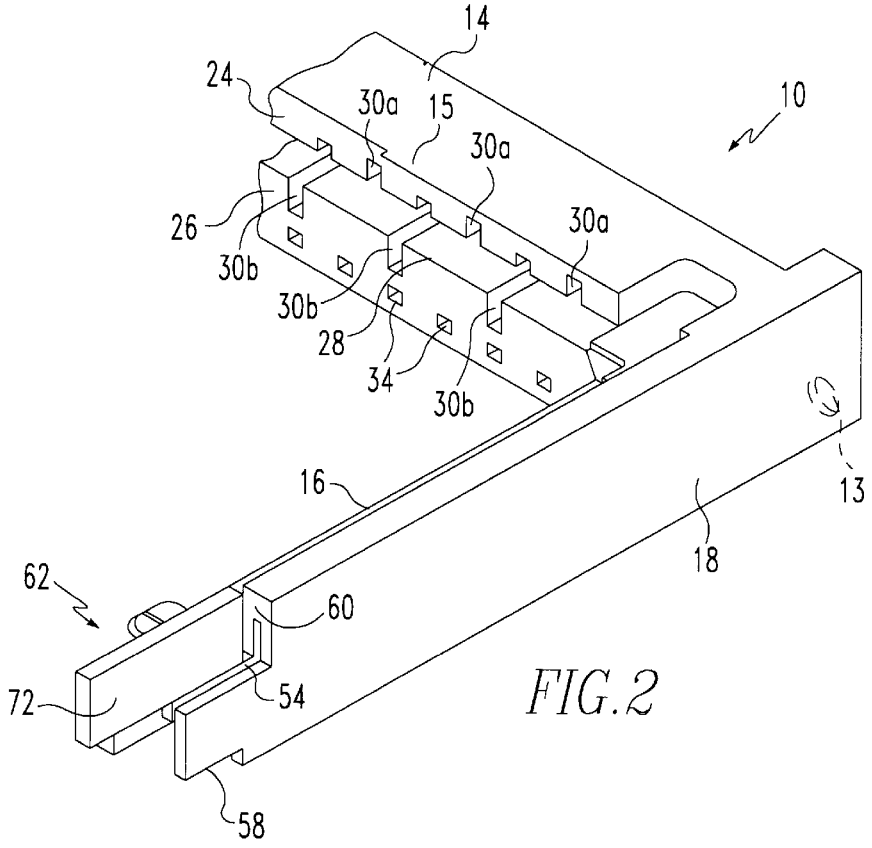
FIG. 2 is a schematic perspective view showing a structure of part of a housing.

As shown in FIG. 2, the housing 14 has a pair of opposing walls 24 and 26 which are arranged at the upper and lower sides, respectively. Between the walls 24 and 25 there is formed an insertion opening 28 for receiving the printed circuit board 8. The latch arm 16 is bonded to the lower wall 26, at a part close to the longitudinal end portion of the insertion opening 28. The upper surface at the side of the insertion opening 28 is arranged at almost the same level as the upper surface of the lower wall 26. Therefore, the latch arm 16 has a structure which can be easily curved, with a sectional area smaller than that of the support arm 18. On the other hand, the support arm 18 has a comparatively rigid structure.

The socket 10 for a printed circuit board according to the embodiment is mounted on a surface of the mother board (not shown) in a horizontal state, with the insertion opening 28 opening sideways. A positioning projection 13 is provided at the housing 14. In addition, the socket is of the type called DIMM (Dual in-line Memory Module), so classified in terms of the fashion of arranging the contacts.

Contact grooves 30*a* opening toward the insertion opening 28 are formed at the upper wall 24, with a predetermined distance. A holder member 15 projects from a part which is close to each latch arm 16. This member 15 is provided to prevent the printed circuit board 8 from rotating at a predetermined angle when the printed circuit board 8 is detached as will be described below. The member 15 can be formed entirely at the wall 24 along a contact row. It is preferable to provide the holder members 15 only at both side portions, respectively, to expose the lower wall 26 as much as possible and facilitate the insertion of the printed circuit board 8. Other contact grooves 30*b* opening toward the insertion opening 28 are also formed at the lower wall 26, spaced apart from each other, and the lower wall 26 projects to a position longer than the holder members 15 of the upper wall 24.

The contact grooves 30*a* of the wall 24 and contact grooves 30*b* of the wall 26 are alternately arranged in the axial direction of the insertion opening 28. The spring contacts 12 are fitted in the respective contact grooves 30*a* and 30*b*. The spring contacts 12 shown in FIG. 3(A) are fitted in the contact grooves 30*a*, and the spring contacts 12 shown in FIG. 3(B) in the contact grooves 30*b*. Contacts formed by stamping a plate member of, for example, copper alloy can be used as these spring contacts 12.

Figure 3B:
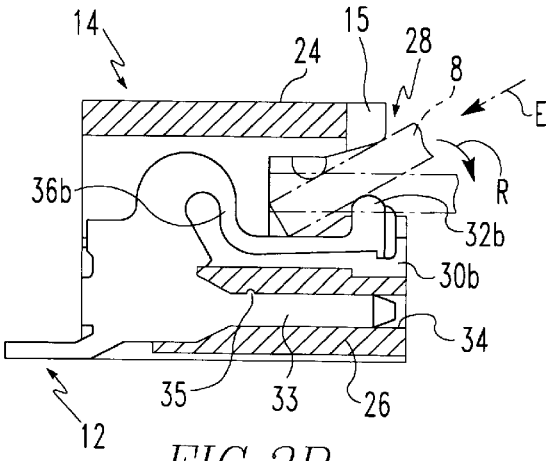
FIGS. 3(A) and 3(B) are cross sectional views showing an arrangement of a spring contact in the housing.
Figure 3A:
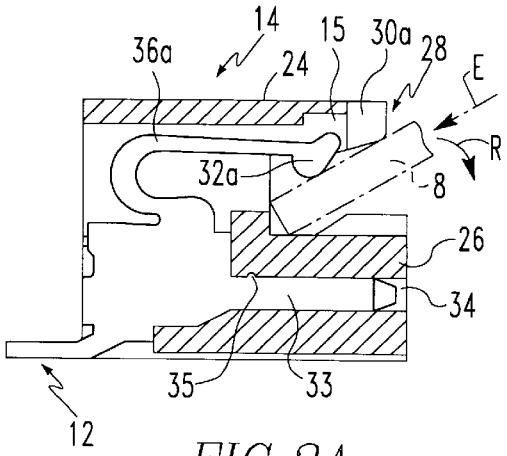

As shown in FIGS. 3(A) and 3(B), the spring contacts 12 have fitting portions 33 fitted in the housing 14. Contacts 32*a* and 32*b* are supported at the fitting portions 33 through spring portions 36*a* and 36*b*. The spring contacts 12 are inserted from the back of the insertion opening 28, i.e. from the left side of the housing 14, as shown in FIGS. 3(A) and 3(B). Their fitting portions 33 are fitted in fitting apertures 34 formed at the lower wall 26. Small projections 35 formed at the fitting portions 33 prevent the spring contacts from falling out of the fitting apertures 34. The contacts 32*a* are arranged together with the spring portions 36*a*, in the contact grooves 30*a* of the upper wall 24, as shown in FIG. 3(A), and project from the contacts 30*a* into the insertion opening 28. The contacts 32*b* are arranged together with the spring portions 36*b*, in the contact grooves 30*b* of the lower wall 26, as shown in FIG. 3(B), and project from the contacts 30*b* into the insertion opening 28. Clearances are provided between the connects 32*a* and 30*b*, and bottom walls of the contacts 30*a* and 30*b*. Terminal portions for connecting to a mother board project from the back of the housing 14.

The contacts 32*a* and 32*b* of the spring contacts 12 form rows of contacts, which extend along the axis of the insertion opening 28, in the insertion opening 28. The contact rows are arranged in an offset fashion with respect to the inserting direction E of the printed circuit board 8. When an edge portion of the printed circuit board 8 is inserted into the insertion opening 28 and the circuit board 8 is rotated in the direction of an arrow R, the contacts 32*a* and 32*b* are pressed by the edge portion. The spring portions 36*a* and 36*b* bias the respective contacts 32*a* and 32*b* toward their initial positions. Due to the spring force, the contacts 32*a* and 32*b* are pressed onto the wire portions arranged at the edge portion, reliably contacting the wire portions. Further, due to the contact rows of this offset arrangement, a moment exerting in a direction inverse to the arrow R is applied to the printed circuit board 8.

Figures 4A, 4B:
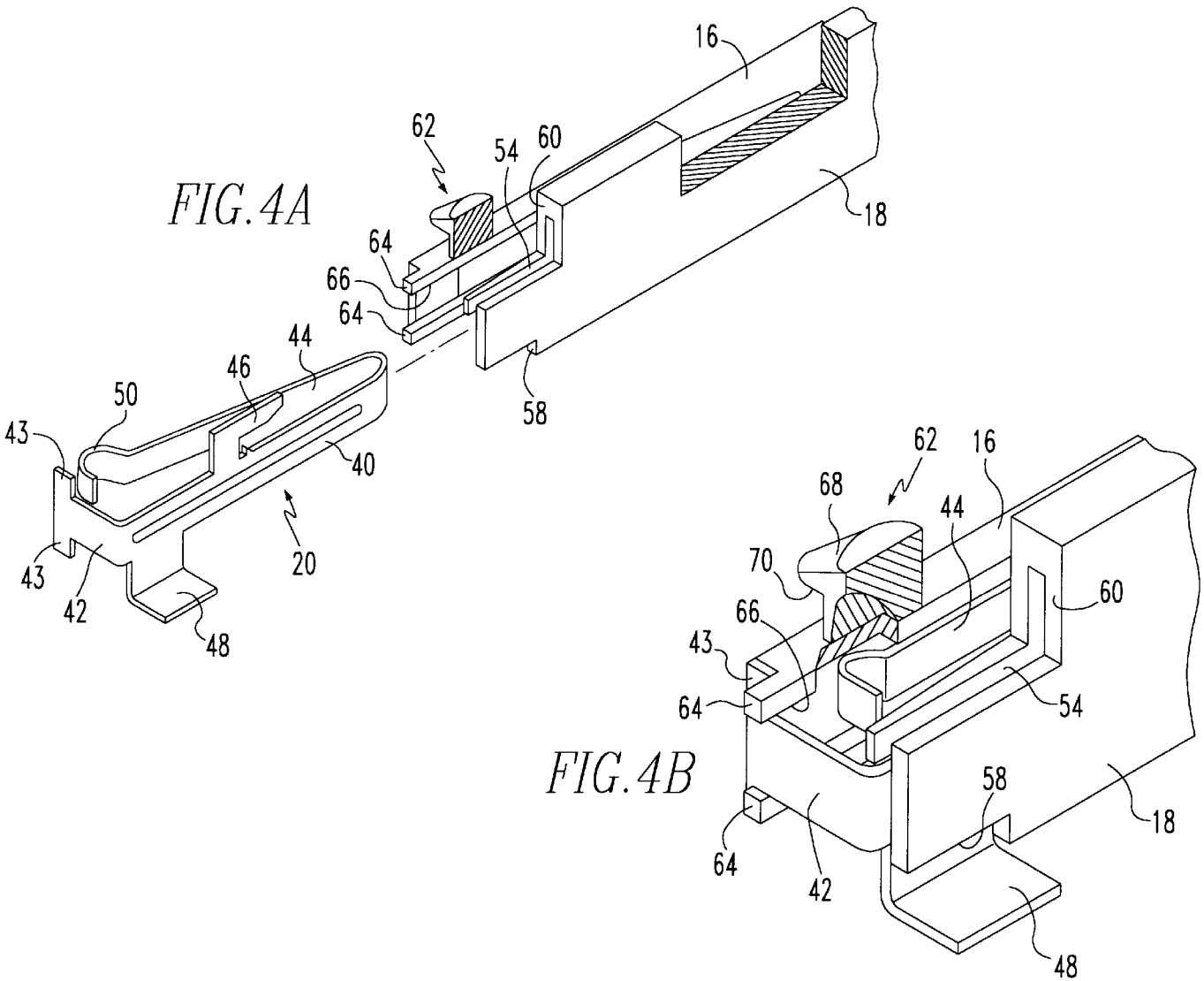
FIGS. 4(A) and 4(B) are partially cutaway and schematic perspective views showing a structure of a latch mechanism.

FIGS. 4(A) and 4(B) show a latch mechanism for retaining the printed circuit board 8 receiving this moment, at each of the side edge portions in its width direction. Since the latch mechanisms for retaining the side edge portions have the same structure, only one of them will be explained.

The latch mechanism of this embodiment comprises the latch arm 16 extending from the housing 14, the support arm 18 and the latch guide 20 fitted in the support arm 18 to guide the latch arm 16.

As shown in FIG. 4(A), the latch guide 20 is formed of one sheet of the plate member of, for example, copper alloy. The latch guide 20 has a fitting portion 40 fitted in a top portion of the support portion 18, a guide portion 42 which is bent almost vertically from one end of the fitting portion 40, and a spring portion 44 which is bent almost inverse from the other end of the fitting portion 40. An L-shaped engaging member 46 projects from the upper edge portion of the fitting portion 40, and a fixing foot 48 for fixing at a mother board by, for example, soldering, projects from the lower edge portion thereof. The guide portion 42 has a rectangular plate shape in which the edge portions arranged above and under the guide portion form the guide edge portions. Projections 43 project laterally from the top portion of the guide portion. The spring portion 44 arranged in a clearance between the latch arm 16 and support arm 18 has a curving portion 50 and can abut on the latch arm 16 through the curving portion 50 when the latch arm 16 is curved.

Figure 5:
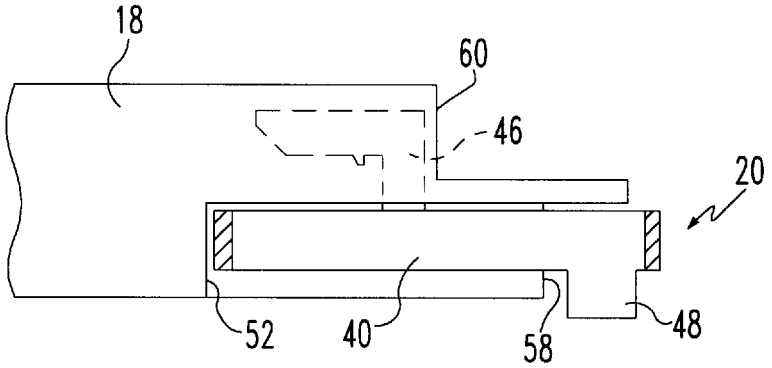
FIG. 5 is a schematic and partially sectional view of a latch guide mounted of a support arm.

As shown in FIG. 5, the side of the latch arm 16 has a concave 52 at the top of the support arm 18, for containing the fitting portion 40. Further, a slot 54 into which the engaging piece 46 is inserted from the top end thereof so that it can be fixed is formed. A cutout portion 58 contains the fixing foot 48 and a cutout portion 60 contains an engaging projection 62 which projects from the latch arm 16.

The latch arm 16 has two protruding portions 64 at its top end as shown in FIG. 4. A concave 66 for containing the curving portion 50 provided at the spring portion 44 of the latch guide 30 is formed at the side facing the support arm 18. The engaging projection 62 projects upward from the upper surface of the latch arm 16, and also from the side of the latch arm 16 toward the support arm 18. A cam portion 68 inclining inwards is provided at the upper side of the engaging projection 62. A fitting portion 70 for fitting the side edge of the printed circuit board is provided at the lower side thereof. An ear portion 72 (FIG. 2) is provided at the side of the support arm 18 of the engaging projection 62. When the ear portion 72 is operated, the fitting portion 70 cam curves and bends the latch arm 16 between the engaging position (shown in FIG. 1) and the releasing position (shown in FIG. 6). At the engaging position, the printed circuit board is held. At the releasing position, the engagement is released.

When the latch guide 20 is fitted in the support arm 18, the engaging piece 46 is matched with the slot 54 and the latch arm 20 is inserted into a clearance between the support arm 18 and latch arm 16, as shown in FIG. 4(A). The spring portion 44 and curving portion 50 are guided into the concave 66 of the latch arm 16, and the fitting portion 40 is arranged in the concave 52 (FIG. 5) of the support arm. In this state, the engaging piece 46 engages with the interior of the support arm 18 inside the slot 56 and strictly holds the latch guide 20. At the same time, the fitting portions abuts on the side surface of the containing concave portion 52. The protruding of the containing concave portion 52. The protruding portions 64 of the latch arm 16 abut on the upper and lower guide edges of the guide portion 42. The projections 43 prevent the latch guide from moving away from the support arm 18. A clearance is formed between the curving portion 50 of the spring portion 44 and the bottom surface of the concave portion 66 containing the curved portion, in the state of fitting with the latch guide 20.

Figure 6:
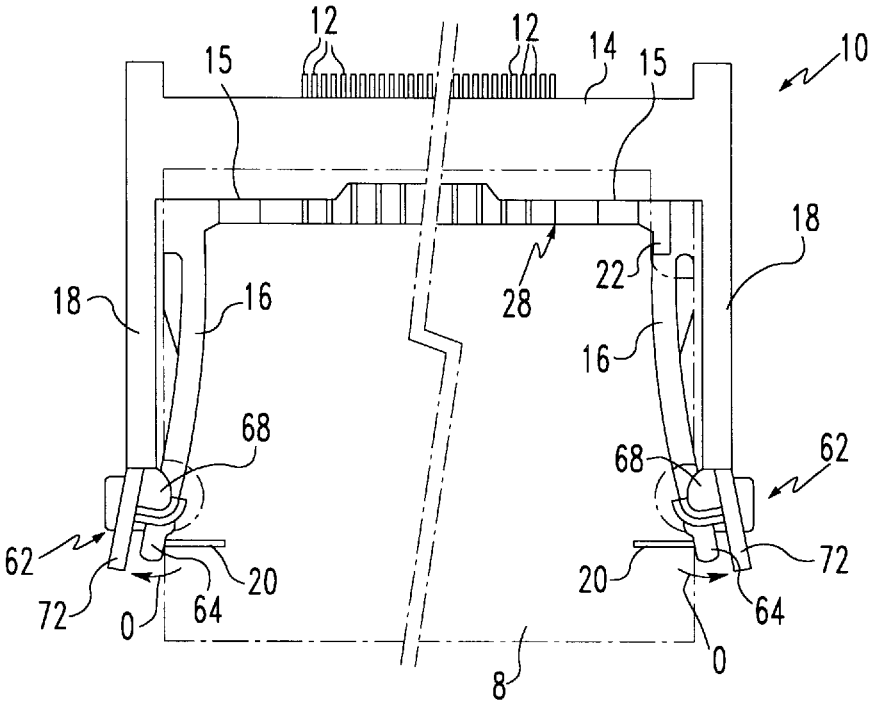
FIG. 6 is a schematic plain view showing the operation of a latch arm.

FIG. 6 shows the operations of the latch mechanism formed in the above manner.

When the printed circuit board 8 inserted into the insertion opening 28 of the housing 14 is rotated and abuts on the engaging projections 62 of the latch arms 16, the cam portions 68 provided at the engaging projections 62 bias the latch arms 16 in the direction of arrows 0. Since the latch arms 16 do not contact the spring portions 44 of the latch arms 20, they immediately start moving from the engaged positions shown in FIG. 1 and the projections 64 slide along the guide edges of the guide portions 42.

As the printed circuit board 8 is further rotated, the latch arms 16 move to the support arms 18, pressing the spring portions 44. The latch arms 16 are thereby opened. As the printed circuit board 8 is further rotated and moved beyond the cam portions 68, the printed circuit board 8 abuts on the upper surfaces of the latch arms 16, 16 and is prevented from moving excessively. The latch arms 16 are returned to the engaged positions due to their own elastic force and the spring force of the latch guides 20. The engagement portions 70 thereby engage with the side edges of the printed circuit board 8, holding it at the rotating position.

The spring portions 44 are provided at the latch guides 20 in this embodiment. The latch arms 16 can be immediately returned even in the state in which the printed circuit board 8 abuts on the upper surfaces of the latch arms 16.

When the printed circuit board 8 is detached, the latch arms 16 are moved to the releasing positions shown in FIG. 6, in the directions of the arrows 0 by means of the ear portions 72. The engagement portions 70 (FIG. 4) of the engaging projections 62 release the engagement with the printed circuit board 8. The printed circuit board 8 is rotated such that it moves away from the latch arms 16, due to the urging force of the spring contacts 12, finally abutting on the holder members 15 provided at the wall 24 of the housing 14. The board 8 is held, not falling out of the insertion opening 28. At this time, the printed circuit board 8 is held and retained without damage, even when the members 15 abuts on the portions which are close to the proximal end portion of the printed circuit board 8 and where the side edges thereof, i.e. circuits are not arranged and when a great moment applies due to the urging force of the spring contacts 12.

When the latch arms 16 move between the engaged position and released position, the engaging projections 62 are moved along the flat surface of the printed circuit board 8 since the projection 43 are guided on the guide edges formed at the edges of the guide portions 42. The engagement portions 70 of an insulating material are thereby engaged smoothly with the side edges of the printed circuit board 8. In addition, a force of the curving or twisting direction, which applies from the printed circuit board 8 to the latch arms 16 through the engagement portions 70 can be transmitted to the support arms 18 through the guide portions 42 and fitting portions 40, and further to the mother board through fixing portions 48. Therefore, it is possible to hold the printed circuit board 8 very firmly while maintaining the curving facility of the latch arms 16. Moreover, since the latch guides 20 made of metal are contained between the latch arms 16 and support arms 18, the metal portions are not exposed to the outside and the safety of the daughter board, etc. can be thereby secured.

As described above, according to the socket for a printed circuit board, of this invention, even if the number of spring contacts are increased, it is possible to easily and certainly detach the printed circuit board without damaging it, due to members of insulating material.

What is claimed is:

1. A socket for a printed circuit board, comprising:

a housing having an insertion opening having an axis for receiving the printed circuit board, said opening provided between first and second opposed walls wherein the first wall is shorter than the second wall;

a plurality of spring contacts having contacts projecting from both of the walls into the insertion opening and forming rows extending along the axis of the insertion opening;

a pair of latch arms extending from those portions of said housing which are close to the ends of the insertion opening, to be pushed outwards by the sides of the printed circuit board when the printed circuit board is rotated in such a direction as to press the contacts, and to be returned to initial positions by virtue of their elastic force when the printed circuit board passes, so as to hold the printed circuit board against an urging force of said spring contacts;

holder members partially projecting from the first wall and a latch guide arranged between the holder members and the latch arms, for preventing the printed circuit board urged by the spring contacts from rotating at an angle more than a predetermined value when the latch arms release the printed circuit board;

wherein said housing and said latch arms are formed of an integral member made of insulating material.

2. The socket according to claim 1, wherein said holder members are arranged in the vicinity of the latch arms.

3. The socket of claim 1 wherein the first wall is an upper wall.

4. The socket of claim 1 wherein the latch guides are metal.

5. The socket according to claim 2, wherein one of said walls projects beyond said holder members.

* * * * *